US005708725A

United States Patent [19]

Ito

[11] Patent Number: 5,708,725

[45] Date of Patent: Jan. 13, 1998

[54] WIRELESS HEADPHONE WITH A SPRING-BIASED ACTIVATING POWER SWITCH

[75] Inventor: Masahiko Ito, Tokyo, Japan

[73] Assignee: Sony Corporation, Tokyo, Japan

[21] Appl. No.: 694,117

[22] Filed: Aug. 8, 1996

[30] Foreign Application Priority Data

Aug. 17, 1995 [JP] Japan ..... 7-209679

[51] Int. Cl.[6] ..... H04R 25/00

[52] U.S. Cl. ..... 381/183; 381/187; 381/25

[58] Field of Search ..... 381/183, 187, 381/25, 74; 359/189; 320/2; 200/2; 379/430, 59, 61; 455/78, 90

[56] References Cited

U.S. PATENT DOCUMENTS

| | | | |
|---|---|---|---|
| 3,906,160 | 9/1975 | Nakamura et al. | 381/25 |
| 5,095,382 | 3/1992 | Abe | 381/25 |
| 5,101,504 | 3/1992 | Lenz | 455/78 |
| 5,144,678 | 9/1992 | Lenz | 381/183 |
| 5,321,738 | 6/1994 | Sang-Wook | 379/61 |

FOREIGN PATENT DOCUMENTS

| | | | |
|---|---|---|---|
| 0613320 | 2/1990 | European Pat. Off. | H04R 5/033 |
| 0224003 | 11/1924 | United Kingdom . | |

*Primary Examiner*—Curtis Kuntz
*Assistant Examiner*—Rexford N. Barnie
*Attorney, Agent, or Firm*—Jay H. Maioli

[57] ABSTRACT

A headphone like a cordless headphone including a pair of headphone units, a pair of supporting members, a headband and a pair of spring-biasing members. The headphone units are attached to one end of said supporting members. The headband is shaped in a substantially U-letter in cross section. When the listener wears the headband on the head, the headband is flexibly deformed to press the headphone units against the listener's ears. A pair of spring-biasing members are disposed between the supporting members and the headband. The spring-biasing members spring-bias the supporting members in the direction in which the supporting members are contracted relative to the headband. Frictional forces generated between the supporting members and the headband under the condition that the listener wears the headband on the head are substantially equal to the spring-biasing forces of the spring-biasing members.

10 Claims, 6 Drawing Sheets

WIRELESS HEADPHONE WITH A SPRING-BIASED ACTIVATING POWER SWITCH

BACKGROUND

1. Field of the Invention

The present invention relates to a headphone. More particularly, the present invention relates to a headphone having a supporting member flexible to a headband.

2. Background of the Invention

Heretofore, there are headphones having headphone units slidably attached to a headband in order to properly fit the headphone units against a listener's ears. After the listener has properly fitted the headphone units against the ears, the headphone units are fixed to the headband. There are known headphones in which a plurality of engagement concave portions are formed on one of the headphone units of the headband in the slide direction and an engagement protrusion is formed on the other. When such headphone is in use, the listener fits such engagement protrusion into a predetermined engagement concave portion, the listener can determine a proper position of the headphone unit relative to the headband stepwise, and the user can properly fit the headphone units against the ears.

U.S. Pat. No. 5,406,037, for example, describes a headphone having a free-adjustment function enabling one to freely adjust the headphone units relative to the headband. This headphone includes a substantially U-shaped headband and a suspender provided at the intermediate portion of the headband so as to be extended over respective ends of the headband. When the listener wears the headphone on the head, the suspender is not only deformed in accordance with the shape of the listener's head but also is withdrawn from the headphone body so that the headphone unit can be placed at the position in which the headphone units contact with the auricles.

In the headphone in which the positions of the headphone units are adjusted relative to the headband, each time the listener who wears the headphone on the head is changed, the new listener has to adjust the position of the headphone unit relative to the headband in accordance with the size of the listener's head, which is very cumbersome. Further, when the headphone is not in use, the headphone has to be housed in a headphone case or the like under the condition that the headphone unit portions are extended relative to the headband. Therefore, it is necessary to provide a large space to house the headphone.

While the listener need not adjust the headphone having the suspender and can wear such headphone easily on the head, the headband is projected over the suspender considerably, and hence the appearance of such headphone is deteriorated. Furthermore, since the suspender acts to pull up the headphone unit, a force for pulling up the headphone unit is directly applied to the listener's ears and the headphone units slip up the listener's ears, thereby causing the listener to feel uneasy when the listener is wearing the headphone on the head.

SUMMARY OF THE INVENTION

It is, therefore, an object of the present invention to provide a headphone which can solve the above-mentioned problems.

According to the present invention, there is provided a headphone including at least one headphone unit, a supporting member, a headband, and a spring-biasing member. The headphone unit is attached to the supporting member. The headband has substantially U-shaped cross-section. The supporting member is slidably attached to one end of the headband. When the listener wears the headband on the head, the headband is flexibly deformed to press the headphone unit against the listener's ear. The spring-biasing member is disposed between the supporting member and the headband. The spring-biasing member spring-biases the supporting member in the direction in which the supporting member is contracted relative to the headband. A frictional force generated between the supporting member and the headband when the listener wears the headband on the head is substantially equal to the spring-biasing force of the spring-biasing member.

According to the present invention, there is provided a headphone including at least one headphone unit, a supporting member, a headband, a receiving unit, and a switch. The headphone unit is attached to the supporting member. The headband is substantially U-shaped cross-section. The supporting member is slidably attached to one end of the headband. When the listener wears the headband on the head, the headband is flexibly deformed to press the headphone unit against the listener's ear. The switch is turned on when the supporting member is slid in the direction in which the supporting member is extended relative to the headband. The switch switches the headphone into the operable state.

BRIEF DESCRIPTION OF THE DRAWINGS

The invention will be more readily understood with reference to the accompanying drawings, wherein.

DESCRIPTION OF THE INVENTION

A headphone according to the present invention will hereinafter be described in detail with reference to the drawings. In the embodiment which will be mentioned below, the headphone is a so-called cordless headphone, by way of example. This cordless headphone includes a receiving unit for receiving a signal transmitted in the form of infrared rays serving as a communication medium after an output signal from an acoustic reproducing apparatus serving as a audio source has been modulated by a transmitting apparatus.

Figure 1:
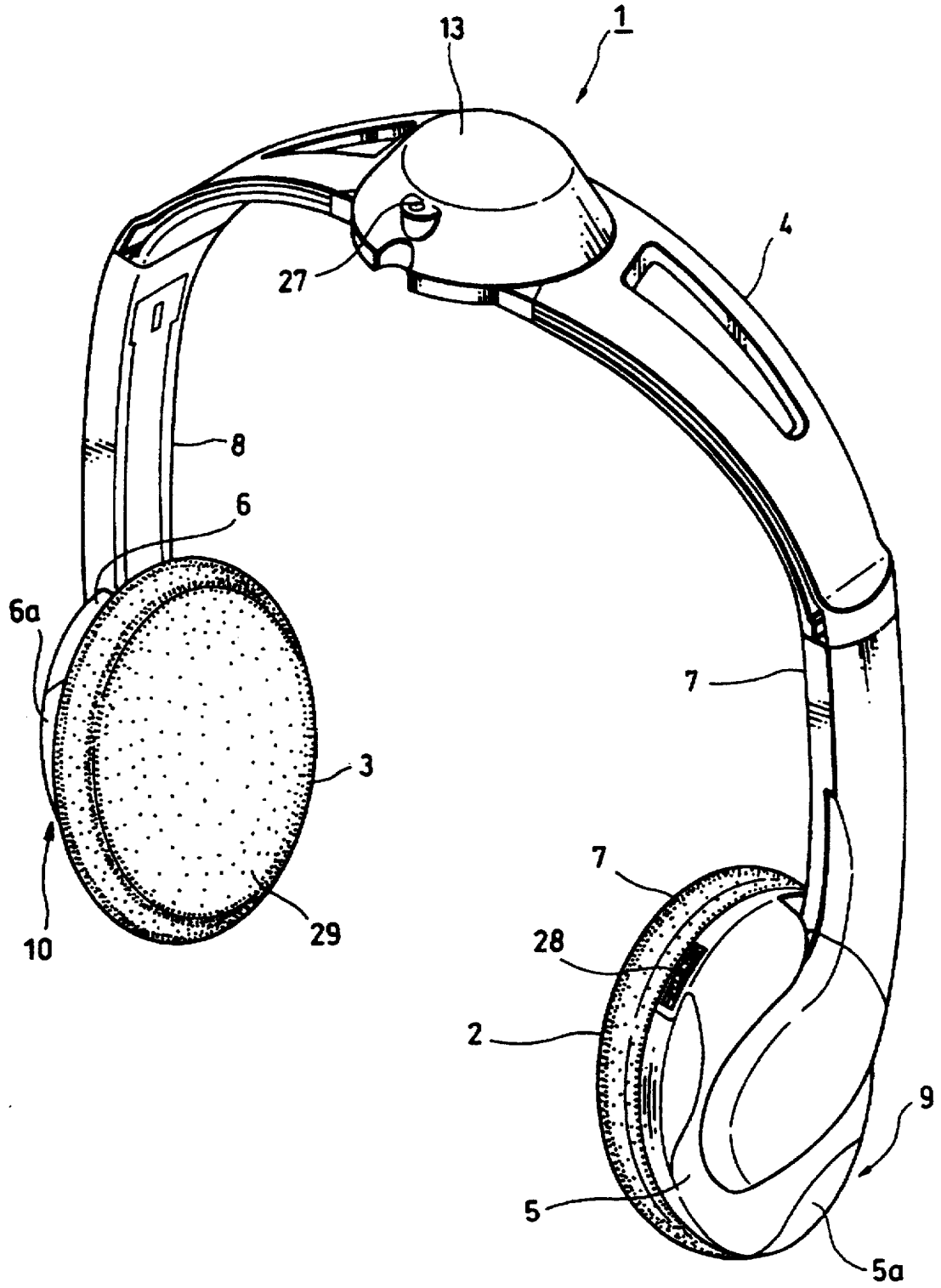
FIG. 1 is a rear perspective view illustrating a cordless headphone according to the present invention under the condition that the cordless headphone is not in use.

As shown in FIG. 1 of the accompanying drawings, a cordless headphone 1 includes a pair of headphone units 2, 3 and a headband 4. A pair of headphone units 2, 3 are disposed at respective ends of the headband 4 in an opposing relationship to each other. FIG. 1 shows the state that slide arms, which will be described later on, are contracted with respect to the headband 4.

The headphone units 2, 3 include housings 5, 8 with speaker units accommodated therein. These housings 5, 6 contain therein signal processing circuits, which will be described later on, together with the speaker units. These housings 5, 6 include light-receiving units 9, 10 for receiving infrared rays transmitted from a transmitting apparatus (not shown). The light-receiving units 9, 10 are composed of window portions 5*a*, 6*a* disposed in the housings 5, 6 and light-receiving devices 24, 24 disposed on the circuit boards in which the signal processing circuits, which will be described later on, housed in the housings 5, 6 are provided. The window portions 5*a*, 6*a* are made of a transparent material or a material easy to pass transmitted infrared rays and are integrally formed with the housings 5, 6 at their positions opposite to the light-receiving devices 24, 24. Ear pads 28, 29 made of a permeable material are attached to the housings 5, 8 at their front surfaces which serve as sound outputting surfaces.

These housings 5, 8 are swingably attached to slide arms 7, 8 in such a manner that these housings 5, 6 can be inclined in accordance with listener's ears when the listener wears the headphone 1 on the head. The slide arms 7, 8 are formed as slightly curved hollow cylindrical portions coupled to the housings 5, 8, i.e., base end portions 7*a*, 8*a*. The slide arms 7, 8 include on their insides formed lids for enabling the headphone to be repaired when the headphone is out of order.

Figure 2:
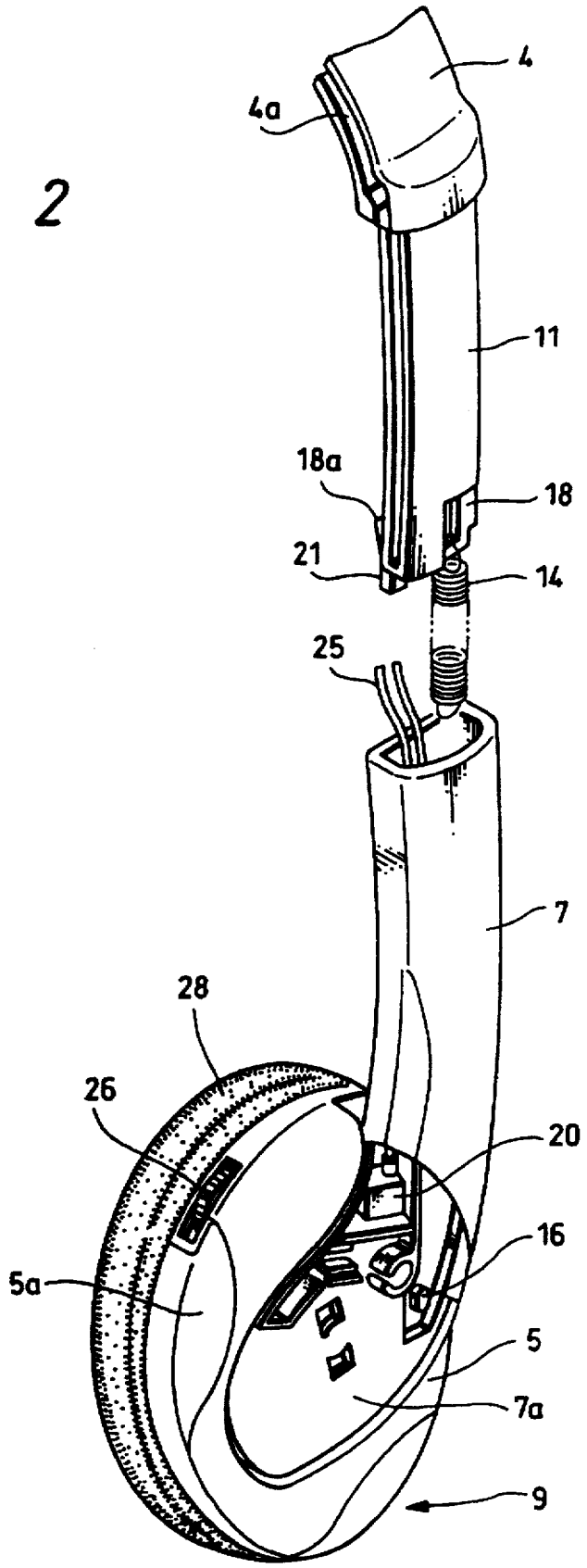
FIG. 2 is an enlarged perspective view illustrating a main portion of the cordless headphone shown in FIG. 1.
Figure 3:
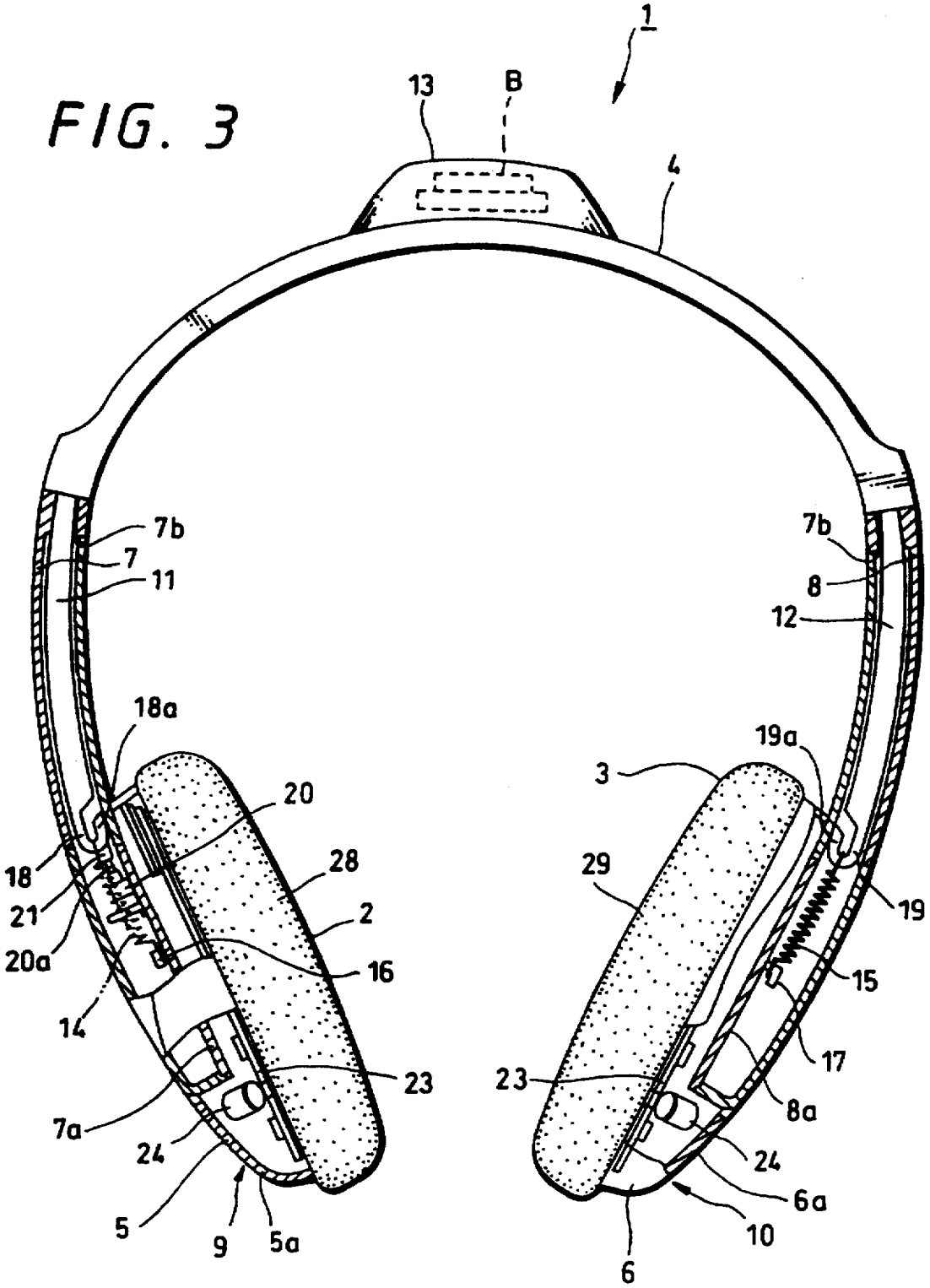
FIG. 3 is a partly-cutaway front view illustrating the cordless headphone shown in FIG. 1 under the condition that the cordless headphone is not in use.

The headband 4 is curved by an elastic member such that its cross-section becomes substantially U-letter shape as shown in FIG. 3. When the listener wears the headphone on the head, the headphone units 2, 3 attached to the respective ends of the slide arms 7, 8 can be pressed against the listener's ears by a spring-biasing force of the headband 4. The headband 4 includes a battery accommodating portion 13 for accommodating a battery B serving as a power supply at its position which is the top of the headband 4. The battery accommodating portion 13 protrudes from the headband 4. The headband 4 has substantially U-shaped respective ends formed by a pair of arm portions 11, 12 into which the slide arms 7, 8 are slidably fitted. The arm portions are formed as flat-plate in cross section as shown in FIGS. 2 and 3 with the result that the hollow portions of the slide arms 7, 8 also have a substantially rectangular shape in accordance with the cross-sections of the arm portions 11, 12. As shown in FIG. 3, there are formed predetermined clearances between the outer surfaces of the arm portions 11, 12 and the inner surfaces of the slide arms 7, 8. The arm portions 11, 12 may be integrally formed with the headband 4 or the arm portions 11, 12 and the headband 4 that were separately formed may be integrally formed together later.

As shown in FIGS. 2 and 3, tension coil springs 14, 15 are extended between the headband 4 and the inner surfaces of the slide arms 7, 8. The tension coil springs 14, 15 are placed within the hollow portions of the slide arms 7, 8 and extended between the respective base end portions 7*a*, 8*a* of the slide arms 7, 8 and the tip ends of the arm portions 11, 12. To this end, hook-shaped spring fixing portions 18, 19 for fixing the tension coil springs 14, 15 are respectively formed on the respective tip ends of the arm portions 11, 12, and spring fixing protrusions 16, 17 are respectively formed on the base end portions 7*a*, 8*a* of the slide arms 7, 8. By the tension coil springs 14, 15, the slide arms 7, 8 and the arm portions 11, 12 are constantly spring-biased in the direction in which they are contracted with each other. In other words, the tension coil springs 14, 15 spring-bias the slide arms 7, 8 so as to be contracted with respect to the headband 4 as shown in FIG. 3. This state will be described below with reference to FIG. 4. Under the condition that the listener wears the headphone 1 on the head, the slide arms 7, 8 are spring-biased in the direction in which they are lifted with respect to the headband 4. Therefore, the tension coil springs 14, 15 have spring-biasing forces larger than the weights of the headphone units 2, 3.

The hook-like spring fixing portions 18, 19 of the arm portions 11, 12 of the headband 4 have at their tip end sides formed locking portions 18*a*, 19*a* for preventing the arm portions 11, 12 from being disengaged from the slide arms 7, 8. When the slide arm 7 is pulled in the direction in which it is expanded with respect to the headband 4, as shown in FIG. 8, the locking portion 18*a* is engaged with a stepped portion 7*b* formed on the inner surface of the slide arm 7, thereby preventing the slide arm 7 from being disengaged from the headband 4. Similarly, although not shown, a stepped portion is also formed on the inner surface of the slide arm 8. When this stepped portion is engaged with the locking portion 19*a*, the slide arm 8 can be prevented from being disengaged from the arm portion 12. Conversely, when the arm portions 11, 12 are inserted into the slide arms 7, 8, the locking portions 18*a*, 19*a* are resiliently deformed in the direction in which they are temporarily contracted by the opening portions of the slide arms 7, 8 and then inserted into the arm portions 11, 12 from the opening portions of the slide arms 7, 8. Thereafter, the locking portions 18*a*, 19*a* are flexibly deformed so as to be expanded in diameter within the hollow portions of the slide arms 7, 8, whereby the slide arms 7, 8 can be prevented from being disengaged from the headband 4.

Figure 4:
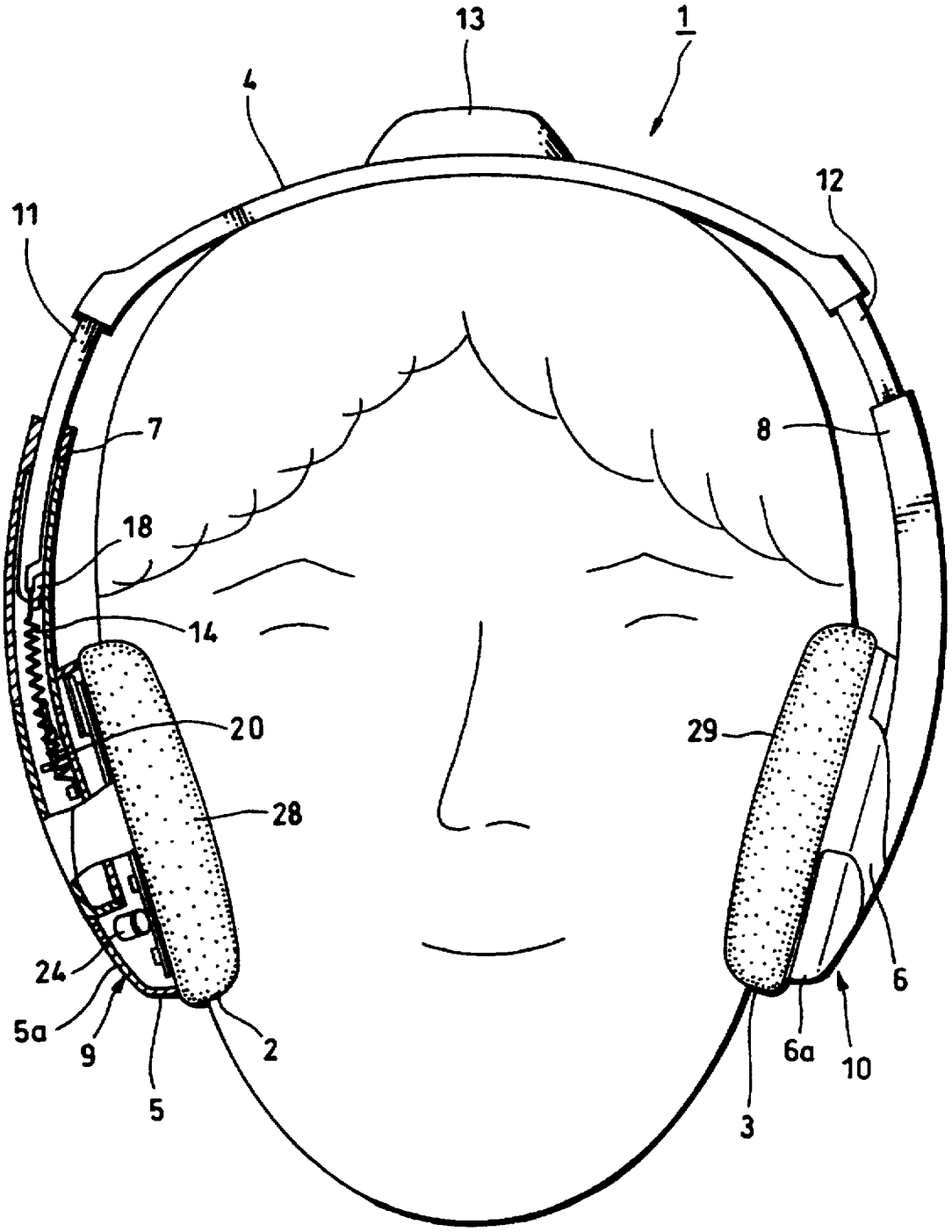
FIG. 4 is a partly-cutaway front view illustrating the cordless headphone shown in FIG. 1 under the condition that the cordless headphone is not in use.

As shown in FIG. 2 and 3, an operation protrusion 21 for pressing an operation member 20*a* of a switch 20 is protruded from the tip end side of one arm portion 11 of the arms portions 11, 12. The switch 20 is provided on the base end portion 7*a* side of the slide arm 7. In this embodiment, the switch 20 is operated as a power supply switch for switching the headphone 1 to the operative state and the inoperative state. When the slide arm 7 is contracted with respect to the headband 4 as shown in FIG. 3, the operation member 20*a* of the switch 20 is pressed by the operation protrusion 21, whereby the headphone 1 is placed in the inoperative state. When on the other hand the slide arm 7 is pulled out from the headband 4 as shown in FIG. 4, the operation member 20*a* of the switch 20 is released from being pressed by the operation protrusion 21, whereby the headphone 1 is switched to the operative state.

Figure 5:
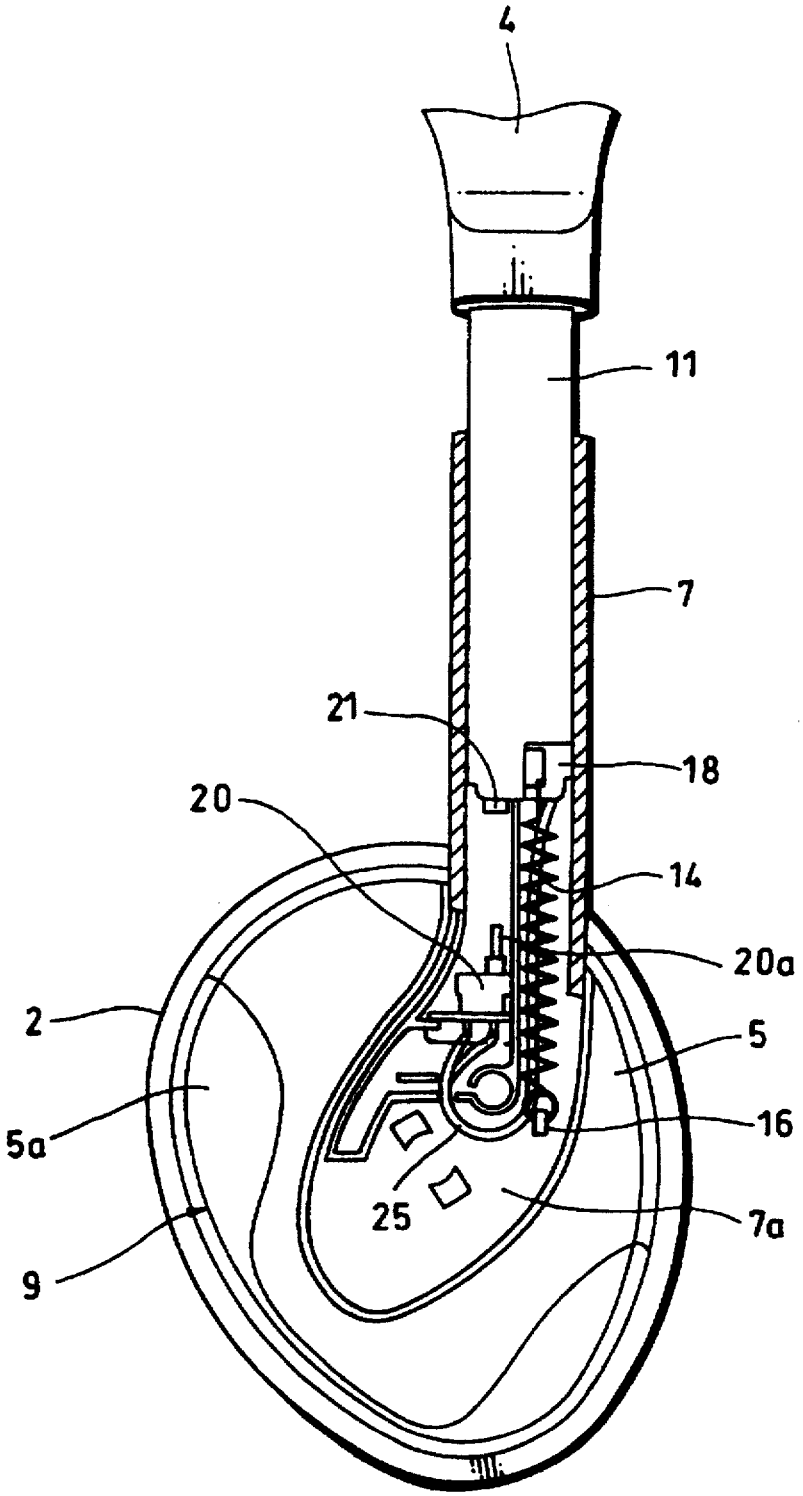
FIG. 5 is a partly-cutaway side view illustrating the headphone assembly in an enlarged-scale in the condition shown in FIG. 4.

In the insides of the housings 5, 6 of the headphone units 2, 3, there are respectively provided the circuit boards 23, 23. These circuit boards 23, 23 have signal processing circuits such as demodulating circuits or driving circuits disposed thereon, though not shown. The demodulating circuits are supplied with output signals from the light-receiving devices 24, 24 and demodulate the output signals supplied thereto. The output signals from the demodulating circuits are supplied to the driving circuits, in which they are processed in a predetermined manner such as amplification, and then supplied to the speaker units. As a result, the output signals from the light-receiving devices 24, 24 are transduced by the speaker units into audible sounds and then outputted. A power from the battery B is supplied through signal lines 25, 25 to the signal processing circuits on the circuit boards 23, 23 housed in the housings 5, 6. The supply of power to the signal processing circuits from the battery B is switched by the switch 20. The signal line 25 is connected at its one end to the circuit board 23 and is also led out from the base end portion 7*a* of the slide arm 7. The other end of the signal line 25 is connected to terminals of the battery accommodating portion 13 through the hollow portion of the slide arm 7. In this embodiment, the signal line 25 is led out from the base end portion 7a of the slide arm 7, travels through the tension coil spring 14 as shown in FIG. 5, is inserted into the groove portion 4a formed on the side surface of the headband 4 as shown in FIG. 2, and reaches the battery accommodating portion 13.

In the headphone unit 1, as shown in FIG. 2, an adjustment dial 26 is disposed on one headphone unit 2. The adjustment dial 28 is used to adjust the volume and is disposed on the circuit board 23 for adjusting a volume of sound outputted from the speaker unit.

As shown in FIG. 1, the battery accommodating portion 13 has on its upper surface an indicating portion 27 for confirming a power supply. The indicating portion 27 is formed of a suitable means such as an LED (light-emitting diode), and is turned on and off in accordance with the operation of the switch 20.

An operation of the thus arranged headphone will be described.

As shown in FIGS. 1 and 3, under the condition that the listener does not wear the headphone 1 on the head, the slide arms 7, 8 are contracted with respect to the headband 4. The slide arms 7, 8 are raised by the tension coil springs 14, 15 over the arm portions 11, 12 with respect to the headband 4, and the slide arms 7, 8 completely cover the arm portions 11, 12. At that time, as shown in FIG. 3, the operation member 20a of the switch 20 is pressed by the operation protrusion 21 provided at the tip end side of the arm 11 so that the switch 20 is placed in its off-state. As a consequence, the power from the battery B is not supplied to the signal processing circuits of the headphone units 2, 3, resulting in the headphone 1 being placed in the inoperative state. At that time, the indicating portion 27 for confirming the power supply is turned off.

As shown in FIG. 4, when the listener wears the headphone 1 on the head, initially, the slide arms 7, 8 are slidably pulled out from the headband 4 against the spring-biasing forces of the tension coil springs 14, 15. In actual practice, after the listener expanded the headband 4 right and left with hands on the headphone units 2, 3 to resiliently deform the headband 4, the listener wears the headband 4 on the head. In this state, the listener pulls the headphone units 2, 8 in the direction in which the headphone units 2, 3 are extended from the headband 4. After the listener has slid the slide arms 7, 8 up to the positions opposing the listener's ears, the listener releases his hold of the headphone units 2, 3 softly and lets the headphone unit 2, 3 contact with the ears so that the listener can wear the headphone 1 on the head as shown in FIG. 4. In that case, since the headphone units 2, 3 contact with the listener's ears with a predetermined pressure generated due to a spring-biasing force of the headband 4, the headphone units 2, 3 can be prevented from slipping from the ears.

While the listener is wearing the headphone 1 on the head, the slide arm 7 is slid against the arm portion 11. Then, as shown in FIG. 5, the operation member 20a of the switch 20 pressed by the operation protrusion 21 provided at the tip end of the arm portion 11 is released, and the switch 20 is switched to the operative state. As a result, the power from the battery B is supplied to the signal processing circuits housed within the housings 5, 6, resulting in the start of a receiving operation and a reproducing operation of the headphone 1. At that time, the indicating unit 27 for confirming the power supply is turned on. Infrared rays transmitted from a transmitting apparatus, not shown, are received by the light-receiving devices 24, 24 of the light-receiving units 9, 10, and the output signals from the light-receiving devices 24, 24 are supplied to the demodulating circuits disposed on the circuit boards 23, 23. Then, demodulated signals from the demodulating circuits are respectively supplied through the driving circuits to the speaker units of the headphone units 2, 3, whereafter they are transduced into audible sounds and then outputted. The listener can enjoy music by listening to the audible sounds outputted from the speaker units.

Figure 6:
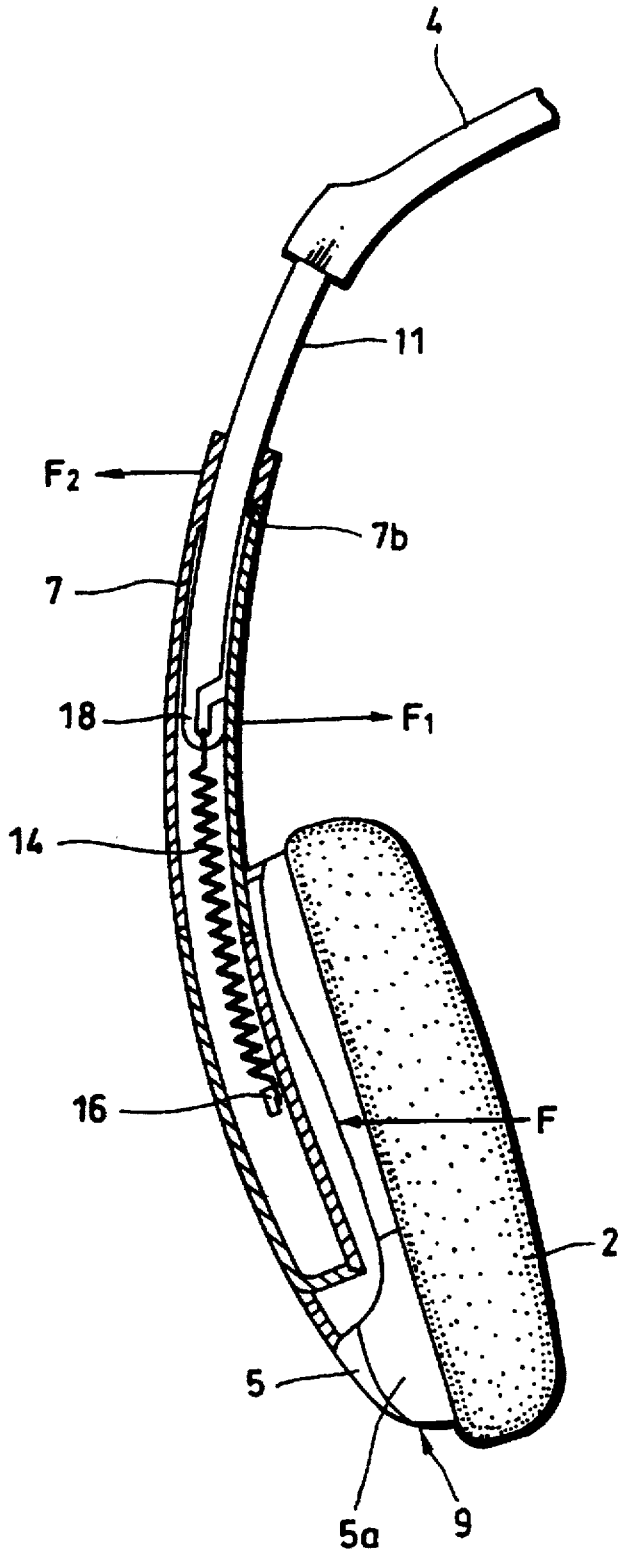
FIG. 6 is a fragmentary cross-sectional view used to explain forces acting on the respective portions of the headphone under the condition that the listener wears the headphone on the head.

Under the condition that the listener wears the headphone 1 on the head as shown in FIG. 4, the headband 4 is subject to a force in the direction in which the space between the headphone units 2, 3 is extended so that the force for urging the headphone units 2, 3 against the listener's ears is generated as a reaction force. This state will be described with reference to FIG. 6.

If a force F for outwardly pushing the headband 4 is applied to the headphone unit 2 when the listener wears the headphone 1 on the head, then a component of force $F_1$ and a component of force $F_2$ orienting in the opposite directions are generated at the portion where the slide arm 7 and the arm portion 11 are contacted with each other. The component of force $F_1$ and the component of force $F_2$ are frictional forces in the opposite directions generated at the portion where the inner surface of the slide arm 7 and the arm portion 11 are contacted with each other. The component of force $F_1$ and the component of force $F_2$ are generated when the arm portion 11 is rotated about a portion near the opening portion of the slide arm 7 within the hollow portion of the slide arm because the slide arm 7 and the arm portion 11 have a clearance therebetween. In other words, the component of force $F_1$ and the component of force $F_2$ are generated when the slide arm 7 is rotated about the portion near the opening portion of the slide arm 7 with respect to the arm portion 11.

Since the component of force $F_1$ and the component of force $F_2$, i.e., frictional forces, generated between the slide arm 7 and the arm portion 11 are greater than or substantially equal to the spring-biasing force of the tension coil spring, a force for raising the slide arm 7 relative to the arm portion 11 is not generated in the headphone unit 2. Similarly, a force for raising the slide arm 7 relative to the arm portion 12 is not generated in the headphone unit 3 side. As a result, under the condition that the listener wears the headphone i on the head as shown in FIG. 4, a force for raising the headphone unit 2 in the upper direction, i.e., toward the headband 4 side is not applied to the headphone unit 2 so that the listener can wear the headphone 1 on the head stably. Even if the frictional forces generated between the slide arms 7, 8 and the arm portions 11, 12 are smaller than the spring-biasing forces of the tension coil springs 14, 15, the frictional forces act in the direction in which the spring-biasing forces of the tension coil springs 14, 15 are canceled out. Therefore, the forces for raising the headphone units 2, 3 applied to the headphone units 2, 3 can be minimized, and the listener can wear the headphone 1 stably.

When the listener removes the headphone 1 from the head, the slide arms 7, 8 are automatically placed in the state shown in FIG. 3 by the tension coil springs 14, 15 disposed between the slide arms 7, 8 and the arm portions 11, 12 and contracted with respect to the headband 4. Concurrently therewith, the operation member 20a of the switch 20 is again pressed by the operation protrusion 21 disposed at the tip end side of the arm portion 11 and the switch 20 is turned off. As a result, the supply of power from the battery B to the signal processing circuits is automatically stopped so that the headphone 1 is placed in the inoperative state. The indicating unit 27 for confirming the power supply is again turned off.

According to the headphone of this embodiment, when the listener wears the headphone, the user can easily adjust the positions of the headphone units to the positions corresponding to the listener's ears only by moving the headphone units in the direction in which the slide arms are lowered under the condition that the listener wears the headband on the head. When the headphone is not in use, the slide arms can be contracted relative to the headband by the tension coil springs. Therefore, the headphone itself can be made compact and the headphone can be accommodated or kept easily.

In the headphone according to this embodiment, the switch for switching the supply of power from the battery serving as the drive power supply is switched in accordance with the slide operation of the slide arms. When the listener wears the headphone on the head, the switch is turned on by pulling the headphone units, i.e., slide arms, thereby supplying the power to the signal processing circuits. When the listener removes the headphone from the head, the slide arms are returned to the initial positions shown in FIG. 1 or FIG. 8 by the tension coil springs so that the supply of power to the signal processing circuit or the like is stopped automatically. As a result, it is possible to prevent a battery from being uselessly consumed when the listener forgets to turn off the switch. Also, it is not necessary for the listener to turn on and off the power supply switch when the listener wears the headphone on the head or removes the headphone from the head.

While the headphone according to the present invention is applied to the cordless headphone using infrared rays as a communication medium as described above, the communication medium is not limited to the infrared rays and may be radio waves such as FM waves. While the present invention is applied to the cordless headphone having the switch functioning as the power supply switch by way of example, the present invention is applied to a headphone without a switch or to a headphone connected to an acoustic device serving as a sound source by a connecting cord. Furthermore, the present invention can be variously modified without departing from the scope of the invention.

By way of example, while the switch functioning as the power supply switch is disposed on the base end side of the slide arm and operated by the arm portion, the present invention is not limited thereto and the switch may be disposed at the tip end side of the arm portion and may be operated by the end portion of the slide arm. In this case, when the slide arms are pulled away from the headband in order for the listener to wear the headphone on the head, the switch is turned off. When the listener removes the headphone from the head and the slide arms are contracted relative to the headband, the switch is turned off.

When the present invention is applied to the headphone which is not only connected to the audio reproducing apparatus serving as the sound source but also has a switch, the switch may be used as a switch for switching an output from a speaker of the audio reproducing apparatus and an output from the headphone. In this case, when the listener wears the headphone on the head, the switch may be turned on to supply the signal supplied to the speaker of the audio reproducing apparatus to the headphone. When the listener removes the headphone from the head, the switch may be turned off to output the signal supplied from the audio reproducing apparatus to the headphone from the speaker of the audio reproducing apparatus.

While the housing and the slide arm of the headphone unit are arranged such that the housing is swingably coupled to the slide arm as described above, the housing may be fixed to or may be integrally formed with the slide arm.

Furthermore, while the headphone has a pair of slide arms having the headphone units slidably attached to the respective ends of the headband as described above, the present invention may be applied to a headphone having a slide arm having a headphone unit slidably attached to one end of the headband.

Having described a preferred embodiment of the invention with reference to the accompanying drawings, it is to be understood that the invention is not limited to that precise embodiment and that various changes and modifications could be effected therein by one skilled in the art without departing from the spirit or scope of the invention as defined in the appended claims.

What is claimed is:

1. A headphone comprising:

a headphone unit including a switch for switching an operation state of said headphone;

a supporting member to which said headphone unit is attached;

a substantially U-shaped headband, said headband having said supporting member slidably attached to one end thereof, and said headband being flexibly deformable for pressing said headphone unit against a listener's ear when the listener wears said headband on the head, wherein said switch is switched by said headband when said headband slides toward and away from said supporting member; and a spring-biasing member connected between said supporting member and said one end of said headband, said spring-biasing member for spring-biasing said supporting member in a direction of drawing said supporting member towards said headband, wherein a frictional force generated between said supporting member and said headband when the listener wears said headband on the head is substantially equal to a spring-biasing force of said spring-biasing member.

2. The headphone according to claim 1, wherein one of said supporting member and said headband forms an arm-like member, the other of said supporting member and said headband forms a cylindrical member fitted into said arm-like member, the frictional force generated between an outer surface of said arm-like member and an inner surface of said cylindrical member is less than said spring-biasing force of said spring-biasing member when the listener does not wear said headband, so that said headband slides toward said supporting member and switches off said switch.

3. A headphone according to claim 2, wherein said spring-biasing member is extended between one end of said headband and said supporting member.

4. A headphone according to claim 1, said headphone further comprising a switch arranged in said headphone unit for switching an operation state of said headphone and wherein said switch is turned on and off by said supporting member when said supporting member slides over said headband.

5. A headphone comprising:

a headphone unit;

a supporting member to which said headphone unit is attached;

a substantially U-shaped headband, said headband having said supporting member slidably attached to one end thereof, and said headband being flexibly deformable for urging said headphone unit against a listener's ear when the listener wears said headband on the head; and a switch arranged in the headphone unit and being turned on by said headband when said headband is slid in a direction in which said headband is drawn away from said supporting member, said switch switching to an operation state of said headphone.

6. The headphone according to claim 5, wherein said headphone unit includes:

a receiving unit for receiving a transmitted signal;

signal processing means for signal processing an output signal from said receiving unit; and a speaker unit for receiving said output signal from said signal processing means, and wherein operation of said signal processing means is switched ON/OFF by said switch.

7. The headphone according to claim 6, wherein said switch is turned off when said headband is slid towards said supporting member.

8. A headphone according to claim 7, wherein said switch is turned on and off by said supporting member.

9. The headphone according to claim 6, wherein said receiving unit comprises a light-receiving unit for receiving transmitted infrared rays and said light-receiving unit is disposed on said headphone unit.

10. The headphone according to claim 5, wherein said headphone further comprises spring-biasing means connected between said supporting member and said headband for spring-biasing said supporting member in a direction in which said supporting member is drawn toward said headband, and wherein a spring-biasing force generated by said spring-biasing means becomes substantially equal to a frictional force generated between said supporting member and said headband when the listener wears said headphone on the head and the frictional force is less then the spring-biasing force when the listener does not wear said headphone.

* * * * *